US008485616B2

(12) United States Patent
Chen et al.

(10) Patent No.: US 8,485,616 B2
(45) Date of Patent: Jul. 16, 2013

(54) SLIDE ASSEMBLY WITH BUFFERING MEMBER FOR REDUCING IMPACT AND NOISE

(75) Inventors: Ken-Ching Chen, Kaohsiung Hsien (TW); Chi-Chih Chou, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 13/023,640

(22) Filed: Feb. 9, 2011

(65) Prior Publication Data

US 2012/0201484 A1 Aug. 9, 2012

(51) Int. Cl.
*A47B 88/04* (2006.01)

(52) U.S. Cl.
USPC ..... 312/333

(58) Field of Classification Search
USPC ..... 312/333, 334.44, 334.46, 334.47, 312/334.8, 334.1, 334.11, 330.1, 319.1, 334.7; 384/1, 20, 21, 228
See application file for complete search history.

(56) References Cited

U.S. PATENT DOCUMENTS

| | | | | |
|---|---|---|---|---|
| 2,553,138 | A * | 5/1951 | Hendricks | 312/246 |
| 2,733,972 | A * | 2/1956 | Diack | 312/334.8 |
| 3,778,120 | A * | 12/1973 | Hagen et al. | 384/18 |
| 3,904,254 | A * | 9/1975 | Hagen et al. | 384/18 |
| 4,272,139 | A * | 6/1981 | Fler | 312/334.11 |
| 4,469,384 | A * | 9/1984 | Fler et al. | 312/333 |
| 5,181,781 | A * | 1/1993 | Wojcik | 384/21 |
| 5,181,782 | A * | 1/1993 | Wojcik | 384/21 |
| 5,255,983 | A | 10/1993 | Parvin | |
| 5,542,759 | A | 8/1996 | Krivec | |
| 5,730,514 | A | 3/1998 | Hashemi | |
| 6,015,199 | A * | 1/2000 | Netzer et al. | 312/334.8 |
| 6,145,945 | A * | 11/2000 | Parvin | 312/334.46 |
| 6,244,678 | B1 * | 6/2001 | Dopp et al. | 312/333 |
| 6,254,210 | B1 * | 7/2001 | Parvin | 312/334.46 |
| 6,367,899 | B1 * | 4/2002 | Hwang et al. | 312/334.47 |
| 6,435,636 | B1 | 8/2002 | MacMillan | |
| 6,705,689 | B2 * | 3/2004 | Chen et al. | 312/334.46 |
| 6,729,703 | B2 | 5/2004 | Le | |
| 7,101,081 | B2 * | 9/2006 | Chen et al. | 384/21 |
| 7,108,340 | B2 * | 9/2006 | Lai | 312/334.46 |
| 7,244,005 | B1 * | 7/2007 | Lu | 312/333 |
| 7,520,577 | B2 * | 4/2009 | Chen et al. | 312/334.46 |
| 7,648,214 | B2 * | 1/2010 | Chen et al. | 312/334.47 |
| 7,699,415 | B2 * | 4/2010 | Tseng et al. | 312/333 |
| 7,758,134 | B2 * | 7/2010 | Huang | 312/334.47 |
| 7,857,403 | B2 * | 12/2010 | Chen et al. | 312/334.46 |
| 7,878,607 | B2 * | 2/2011 | Huang et al. | 312/334.46 |
| 7,946,666 | B2 * | 5/2011 | Huang et al. | 312/333 |
| 8,007,060 | B2 * | 8/2011 | Duan et al. | 312/334.44 |
| 8,152,251 | B2 * | 4/2012 | Huang et al. | 312/334.44 |
| 2007/0040485 | A1 * | 2/2007 | Tseng et al. | 312/333 |
| 2008/0197759 | A1 * | 8/2008 | Chen et al. | 312/334.1 |
| 2009/0169140 | A1 * | 7/2009 | Chen et al. | 384/21 |
| 2010/0164340 | A1 * | 7/2010 | Juan et al. | 312/333 |

* cited by examiner

*Primary Examiner* — James O Hansen
*Assistant Examiner* — Kimberly S Wright
(74) *Attorney, Agent, or Firm* — Rosenberg, Klein & Lee

(57) ABSTRACT

A slide assembly includes a first rail, a second rail movable connected to the first rail, a restriction member on the second rail, and a support base movably connected to an open end of the first rail. The second rail is pulled from the open end. The first rail includes an installation hole and a stop at the open end. The support base includes a buffering member contacting the stop of the first rail. When the second rail is completely pulled from the first rail, the restriction member contacts the support base which is moved and compresses the buffering member to reduce the impact force and the noise.

4 Claims, 9 Drawing Sheets

SLIDE ASSEMBLY WITH BUFFERING MEMBER FOR REDUCING IMPACT AND NOISE

FIELD OF THE INVENTION

The present invention relates to a slide assembly, and more particularly, to a slide assembly with a buffering member for reducing impact and noise when the slide assembly is extended.

BACKGROUND OF THE INVENTION

A conventional slide assembly for a drawer generally includes two or three rails and the drawer is movable along the rails by one or two sets of rollers connected to the rails. Furthermore, the drawer sometimes needs to be removed from the rails so that the rails should be detachable. Usually, regardless two or three rails, the rail that connected to the drawer is detachable and such rail includes a restriction member. The fixed rail connected to the cabinet or frame includes an open end to which the movable rail is retractably connected. A support base is connected to the open end. For three-rail slide assembly, there is an extending rail movably connected between the fixed rail and the movable rail. The extending rail has the support base at the front end thereof. When the restriction member contacts the support base, the movable rail is prevented from dropping off from the fixed rail, or the movable rail is detached from the fixed rail by releasing the contact status between the restriction member and the support base.

However, if the movable rail, the restriction member, the support base and the fixed rail or the extending rail don't have a proper buffering function therebetween, the operation of the drawer is not smooth and noise is generated.

SUMMARY OF THE INVENTION

The present invention intends to provide a buffering member that is used to reduce the impact force and the noise when the rails are completely pulled out.

The present invention relates to a slide assembly and comprises a first rail having a first wall, a second wall located corresponding to the first wall, and a side wall connected between the first and second walls. The side wall, the first wall and the second wall define a path. The first rail has an open end located at a front end of the path. The open end has a stop disposed on the side wall. A second rail is movably connected to the path of the first rail and movable along the first rail and extended from the open end. A longitudinal direction is defined as a direction that the second rail is movable along the first rail. A restriction member is connected to the second rail. A support base is movably connected to the path of the first rail and located corresponding to the open end. The support base has a first support portion, a second support portion located corresponding to the first support portion, and a side portion connected to the first and second support portions. A block is connected to the side portion and located corresponding to the restriction member. The first and second support portions are encompassed by the first wall and the second wall of the first rail. A buffering member is located between the side portion and the stop of the first rail. When the side portion of the support base is close to the stop of the first rail, the buffering member is compressed.

Preferably, the first rail includes an installation hole and the support base includes an installation portion which is located in the installation hole. A longitudinal length of the installation hole is larger than a longitudinal length of the installation portion.

Preferably, the buffering member is a block with a boss, and the first rail has a hole in the stop so as to receive the boss therein. A recess is defined in first rail and the buffering member is received in the recess. A part of the buffering member is inserted into the installation hole of the first rail and contacts the installation portion of the support base.

Preferably, the support base includes an elongate slot and the first rail includes a fixing hole. A pin extends through the elongate slot and is fixed to the fixing hole. A longitudinal length of the elongate slot is larger than a diameter of a pin body of the pin that extends through the elongate slot.

Preferably, the buffering member is connected to the side portion and has at least one bent portion. The stop of the first rail includes a reception hole. The at least one bent portion is received in the reception hole and contacts the stop.

Preferably, the buffering member is a spring and the stop of the first rail includes a reception hole. The spring is located in the reception hole and contacts the stop.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
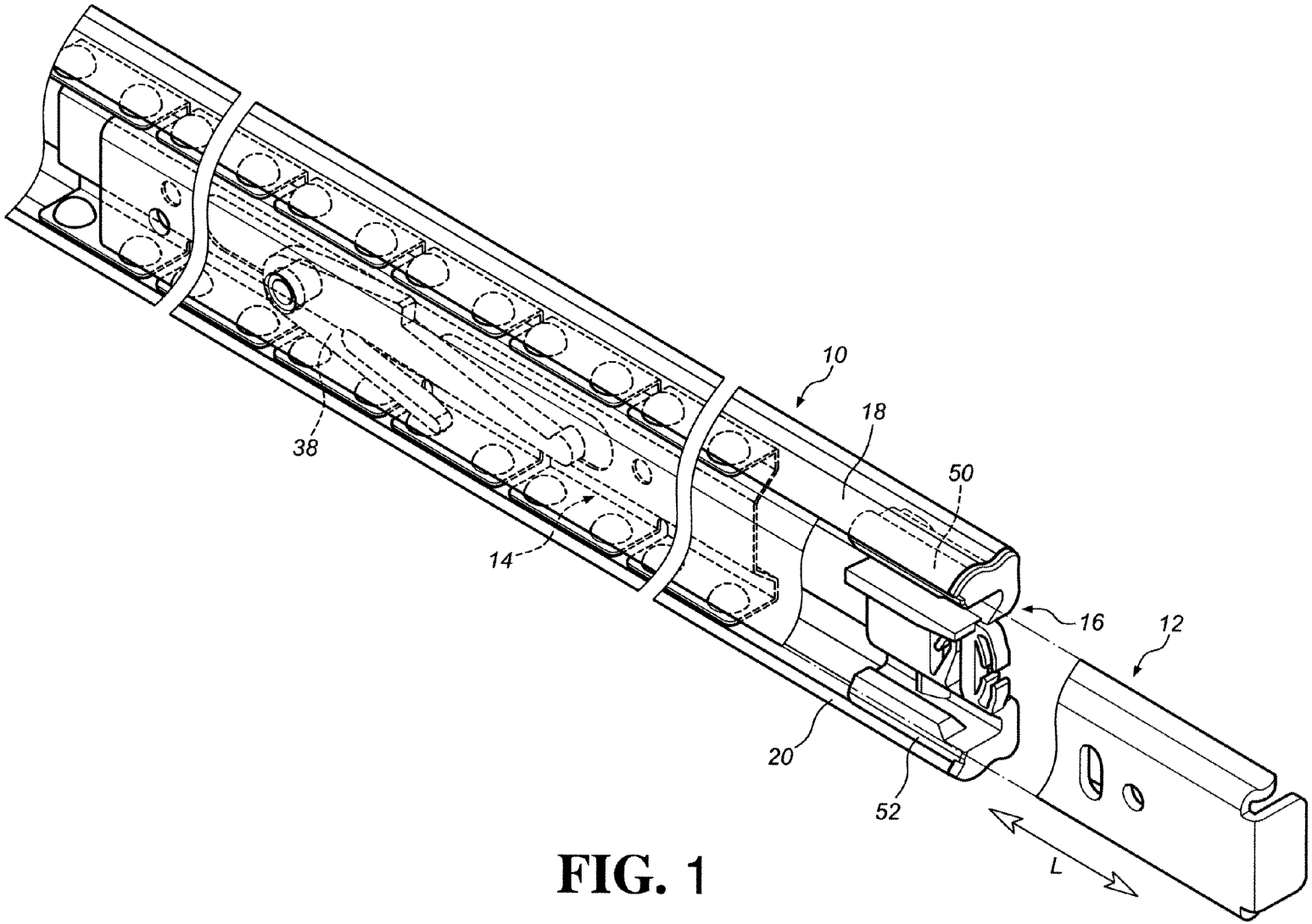
FIG. 1 is a perspective view to show the slide assembly of the first embodiment of the present invention.
Figure 2:
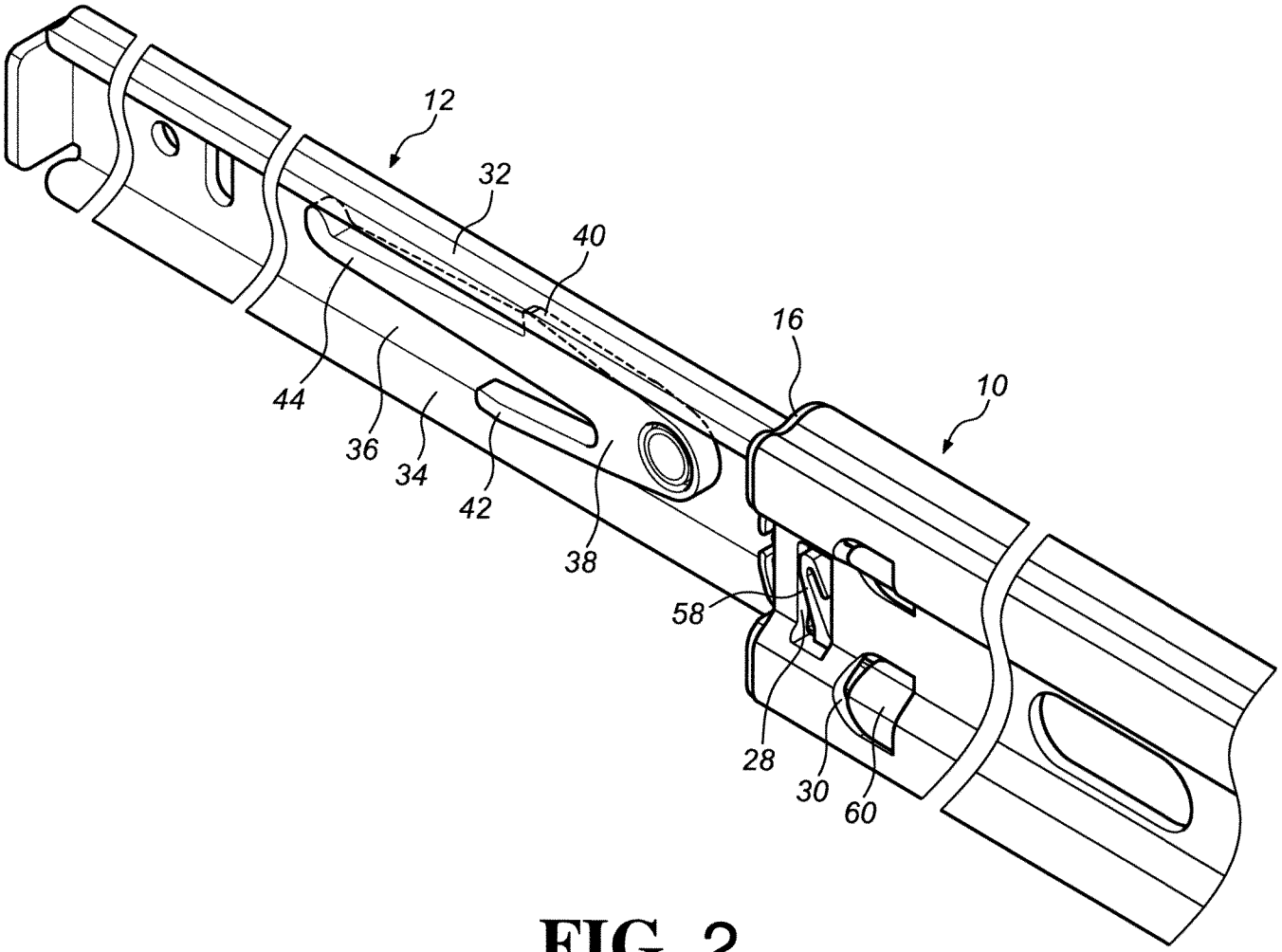
FIG. 2 is another perspective view to show the slide assembly of the first embodiment of the present invention, wherein the slide assembly is in its open status.

Referring to FIGS. 1 and 2, the slide assembly of the first embodiment of the present invention comprises a first rail 10, a second rail 12 movably connected to the first rail 10, a bearing retainer 14 located between the first and second rails 10, 12 so as to guide the second rail 12 to be slid relative to the first rail 10, and a support base 16 connected to the front end of the first rail 10 to support the second rail 12 so that when the second rail 12 is pulled, the second rail 12 is stopped at a desired position. The longitudinal direction "L" is defined as the direction that the second rail 12 is movable along the first rail 10.

Figure 3:
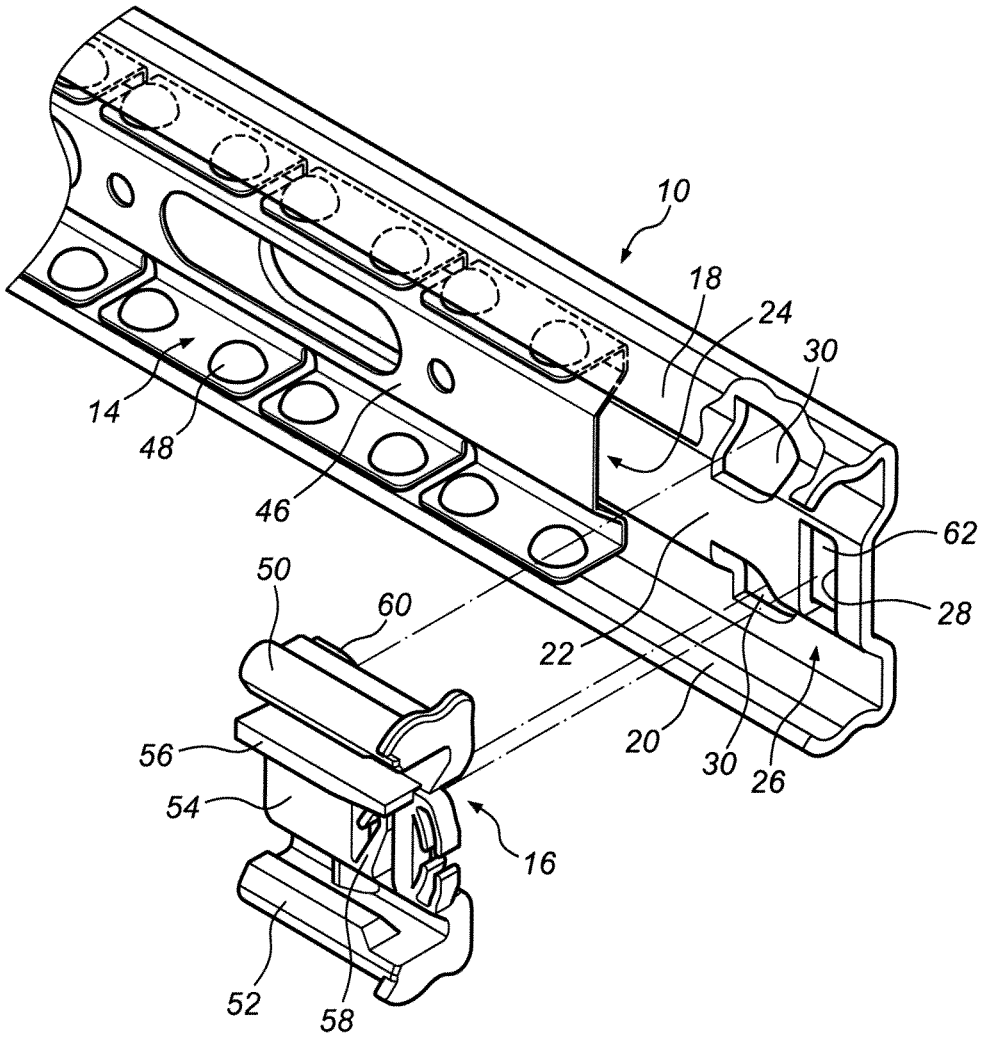
FIG. 3 shows that the support base is connected to the first rail of the slide assembly of the first embodiment of the present invention.

As shown in FIG. 3, the first rail 10 has a first wall 18, a second wall 20 located corresponding to the first wall 18, and a side wall 22 connected between the first and second walls 18, 20. The side wall 22, the first wall 18 and the second wall 20 define a path 24. The first rail 10 has an open end 26 located at the front end of the path 24. The open end 26 has a stop 28 disposed on the side wall 22. The first rail 10 includes an installation hole 30 which can be a single hole or a pair of holes.

The second rail 12 is movably connected to the path 24 of the first rail 10 and comprises a top wall 32, a bottom wall 34 located corresponding to the top wall 32, and a middle wall 36 connected to the top and bottom walls 32, 34. A restriction member 38 is connected to the middle wall 36 of the second rail 12. The restriction member 38 includes a lock portion 40, a resilient leg 42 contacting the bottom wall 34 of the second rail 12, and a lever 44 located between the lock portion 40 and the resilient leg 42. By operation of the lever 44, the lock portion 40 is moved and unlocks the support base 16, such that the second rail 12 can be separated from the first rail 10.

As shown in FIG. 3, the bearing retainer 14 is movably connected to the first rail 10 and includes a retainer plate 46, and multiple ball bearings 48 are connected to the retainer plate 46.

Figure 4:
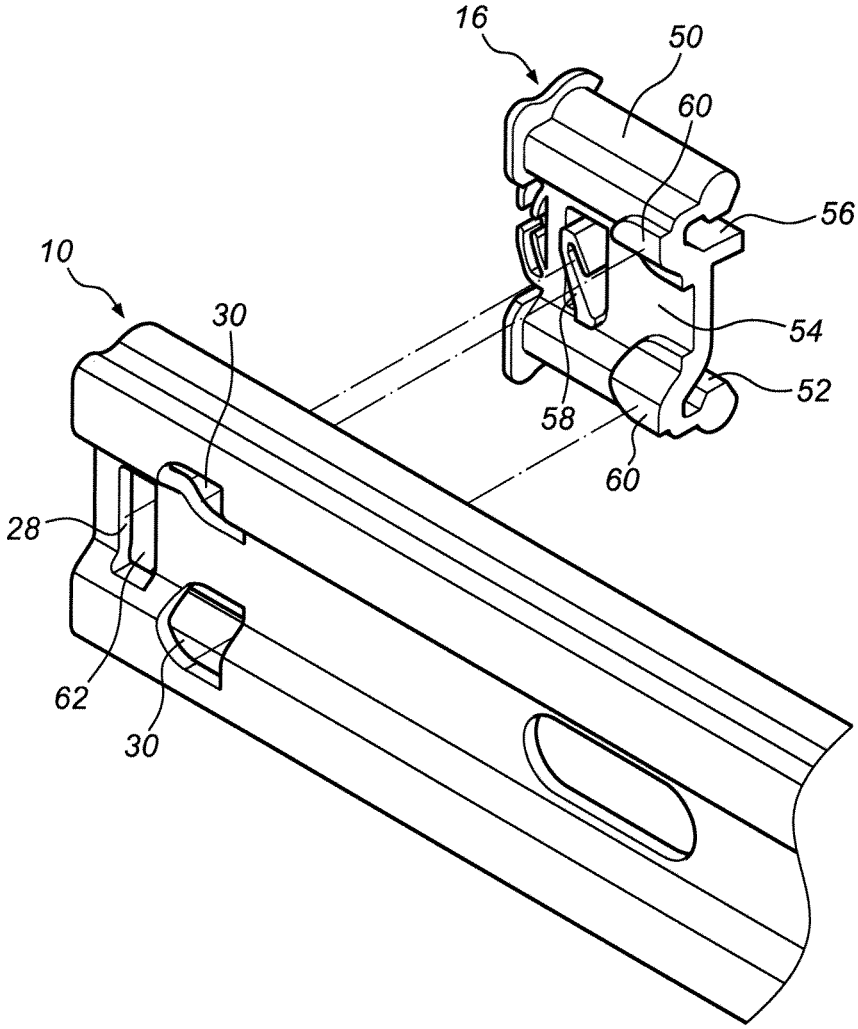
FIG. 4 is another view to show the support base to be connected to the first rail of the slide assembly of the first embodiment of the present invention.

As shown in FIG. 4, the support base 16 is movably connected to the path 24 of the first rail 10 and located corresponding to the open end 26. The support base 16 comprises a first support portion 50, a second support portion 52 located corresponding to the first support portion 50, a side portion 54 connected to the first and second support portions 50, 52, and a block 56 connected to the side portion 54 and located corresponding to the restriction member 38. The first and second support portions 50, 52 are encompassed by the first wall 18 and the second wall 20 of the first rail 10. A buffering member 58 is located between the side portion 54 and the stop 28 of the first rail 10. The support base 16 further has at least one installation portion 60 located corresponding to the installation hole 30 of the first rail 10. Preferably, the longitudinal length of the installation hole 30 is larger than the longitudinal length of the installation portion 60. Preferably, the buffering member 58 is connected to the side portion 54 and has at least one bent portion. The stop 28 of the first rail 10 includes a reception hole 62. The at least one bent portion is received in the reception hole 62 and contacts the stop 28.

Figure 5:
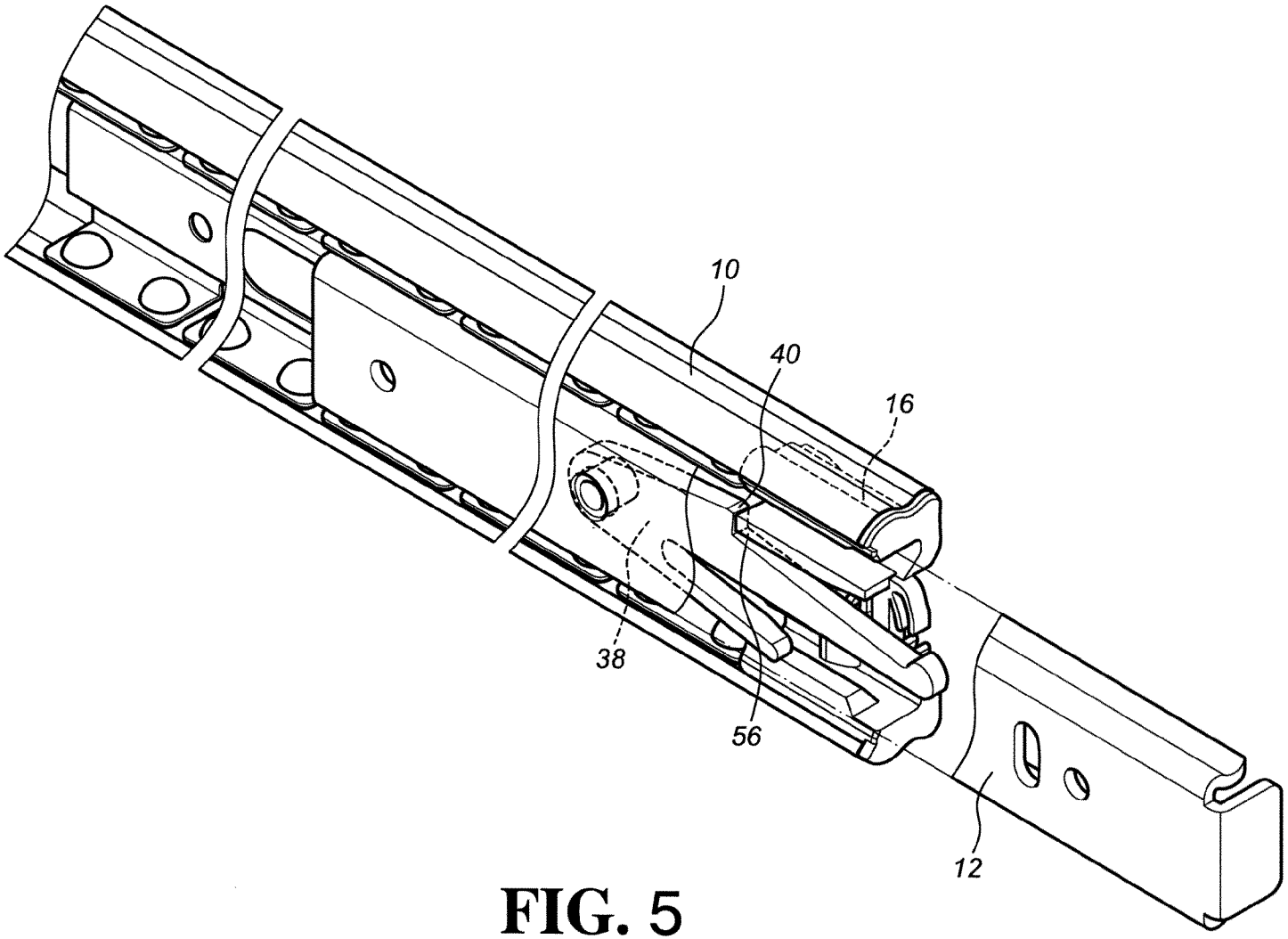
FIG. 5 is a perspective view to show that the slide assembly of the first embodiment of the present invention is completely pulled out.

FIG. 5 shows that the second rail 12 is completely pulled from the first rail 10, wherein the restriction member 38 is moved with the second rail 12. When the restriction member 38 reaches the support base 16, the lock portion 40 of the restriction member 38 contacts the block 56 of the support base 16, so that the second rail 12 can be pulled a distance and stopped so as to prevent it from dropping off.

Figure 6:
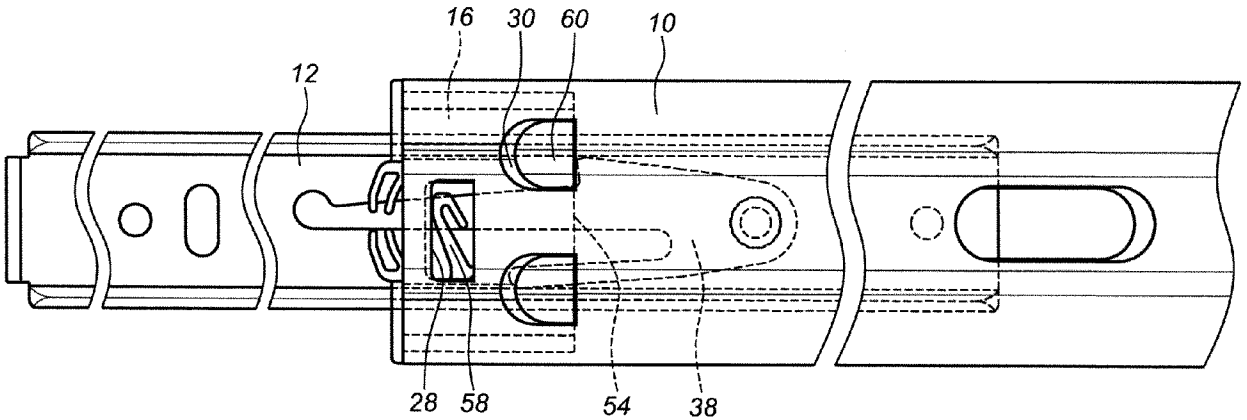
FIG. 6 is a view to show that the slide assembly of the first embodiment of the present invention is completely pulled out.
Figure 7:
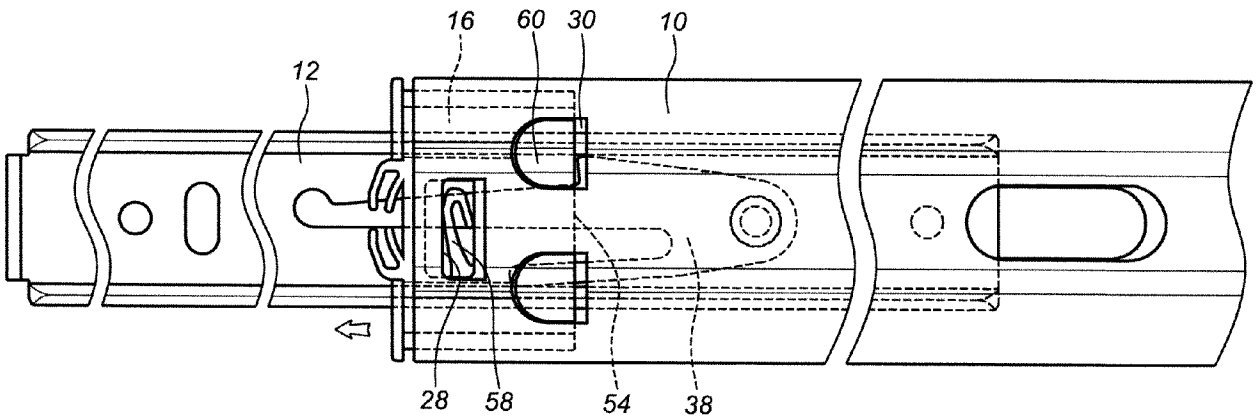
FIG. 7 shows that the buffering member is compressed when the slide assembly of the first embodiment of the present invention is completely pulled out.

As shown in FIG. 5, when the block 56 of the support base 16 is hit hard by the lock portion 40 of the restriction member 38, as shown in FIGS. 6 and 7, the installation portion 60 of the support base 16 is movable in the installation hole 30 of the first rail 10, so that the installation portion 60 moves in the installation hole 30 at the moment of impact. The side portion 54 moves close to the stop 28 of the first rail 10. The buffering member 58 contacts the stop 28 of the first rail 10, and the buffering member 58 is compressed and deformed so as to reduce the impact force and noise.

Figure 8:
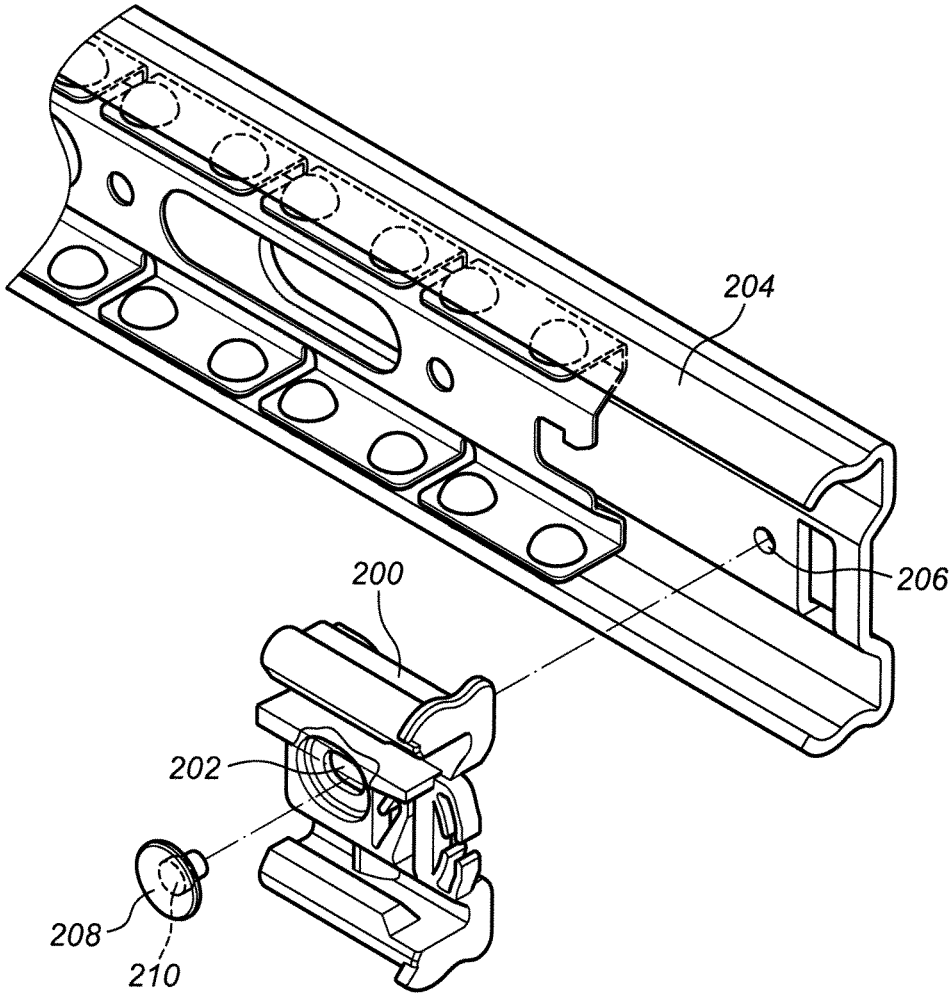
FIG. 8 is an exploded view to show the second embodiment of the slide assembly of the present invention.

FIG. 8 shows the second embodiment of the present invention. The support base 200 includes an elongate slot 202 and the first rail 204 includes a fixing hole 206. A pin 208 extends through the elongate slot 202 and is fixed to the fixing hole 206. The longitudinal length of the elongate slot 202 is larger than the diameter of a pin body 210 of the pin 208 that extends through the elongate slot 202. Therefore, the support base 200 is movable relative to the first rail 204 by the elongate slot 202.

Figure 9:
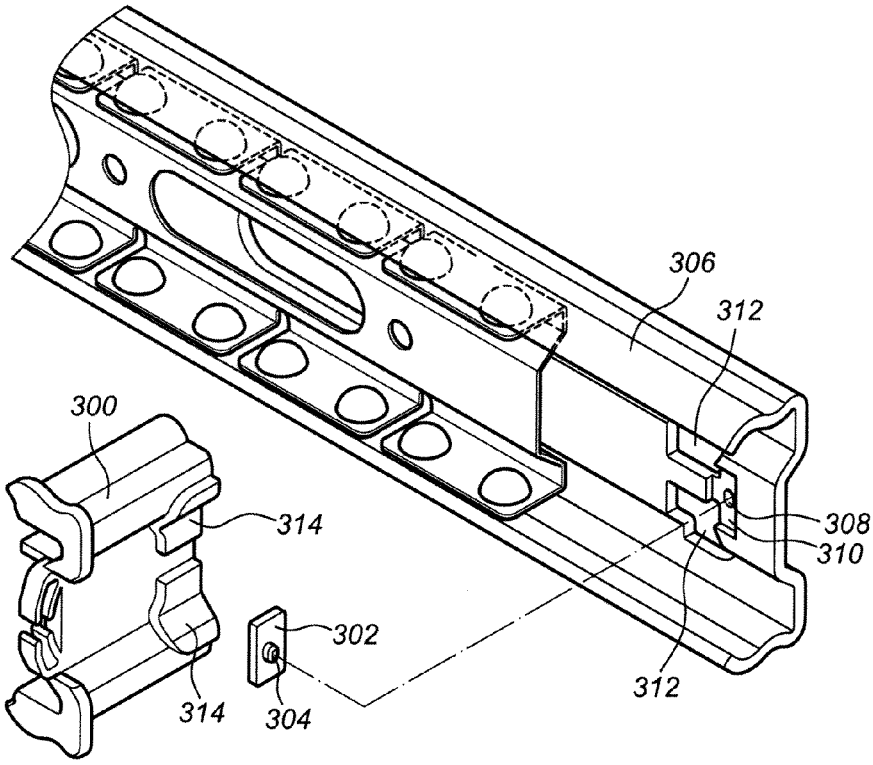
FIG. 9 is an exploded view to show the third embodiment of the slide assembly of the present invention.
Figure 10:
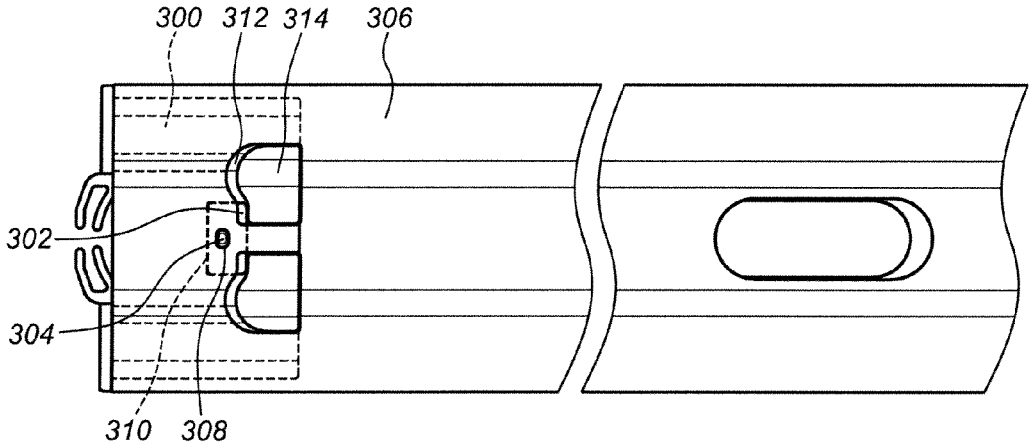
FIG. 10 is a view to show the third embodiment of the slide assembly of the present invention.

FIGS. 9 and 10 show the third embodiment of the present invention. The buffering member 302 of the support base 300 is a block with a boss 304, and the first rail 306 has a hole in the stop 308 so as to receive the boss 304 therein. A recess 310 is defined in first rail 306 and the buffering member 302 is received in the recess 310. A part of the buffering member 302 is inserted into the installation hole 312 of the first rail 306 and contacts the installation portion 314 of the support base 300. Therefore, the buffering member 302 is compressed and deformed.

Figure 11:
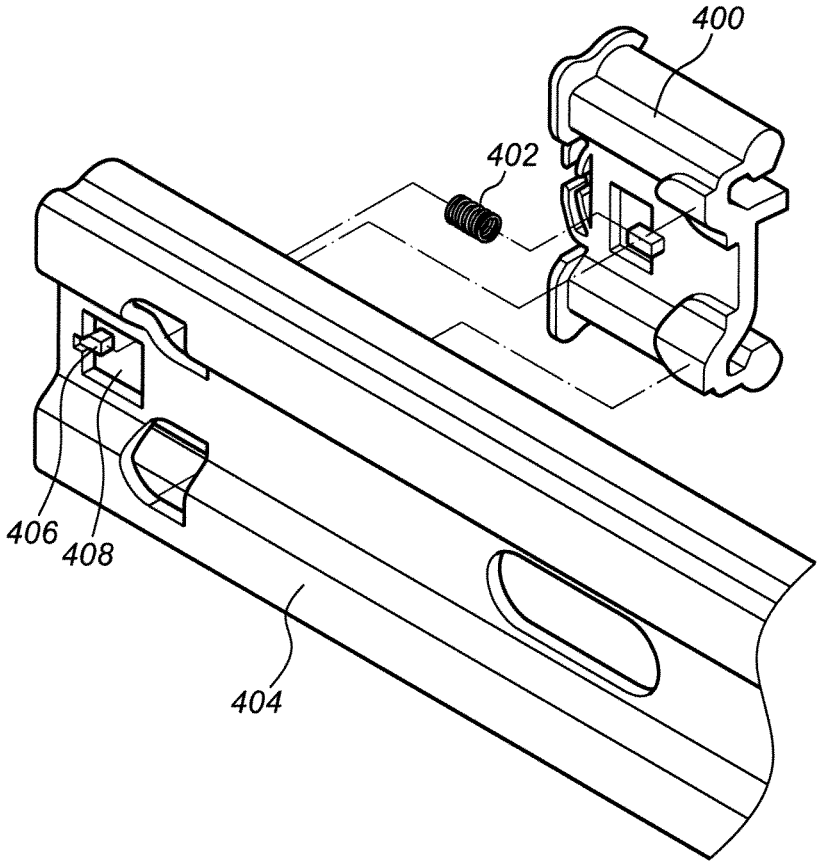
FIG. 11 is an exploded view to show the fourth embodiment of the slide assembly of the present invention.

FIG. 11 shows the fourth embodiment of the present invention. The buffering member 402 of the support base 400 is a spring. The stop 406 of the first rail 404 includes a reception hole 408. The spring is located in the reception hole 408 and contacts the stop 406. The buffering member 402 in the form of a spring is compressed and deformed.

While we have shown and described the embodiment in accordance with the present invention, it should be clear to those skilled in the art that further embodiments may be made without departing from the scope of the present invention.

What is claimed is:

1. A slide assembly comprising:

a first rail having a first wall, a second wall located corresponding to the first wall, and a side wall connected between the first and second walls, the side wall, the first wall and the second wall defining a path, the first rail having an open end located at a front end of the path, the open end having a stop disposed on the side wall;

a second rail movably connected to the path of the first rail and movable in a longitudinal direction along the first rail and extended from the open end;

a restriction member connected to the second rail, a support base movably connected to the path of the first rail and located corresponding to the open end, the support base having a first support portion, a second support portion located corresponding to the first support portion, a side portion connected to the first and second support portions, a block connected to the side portion and located corresponding to the restriction member, the first and second support portions being encompassed by the first wall and the second wall of the first rail, and a buffering member extending from the side portion and deflectively captured against the first rail responsive to the restriction member engaging and longitudinally displacing the support base relative to the first rail to thereby resiliently limit longitudinal displacement of the second rail relative to the first rail, and wherein the first rail includes an installation hole, the support base includes an installation portion which is located in the installation hole, and a longitudinal length of the installation hole is larger than a longitudinal length of the installation portion.

2. The slide assembly as claimed in claim 1, wherein the buffering member is a block with a boss, the first rail has a hole in the stop so as to receive the boss therein, a recess is defined in first rail and the buffering member is received in the recess, and a part of the buffering member is inserted into the installation hole of the first rail and contacts the installation portion of the support base.

3. The slide assembly as claimed in claim 1, wherein the buffering member has at least one bent portion, the stop of the first rail includes a reception hole, and the at least one bent portion is received in the reception hole and contacts the stop.

4. The slide assembly as claimed in claim 1, wherein the buffering member is a spring, the stop of the first rail includes a reception hole, and the spring is located in the reception hole and contacts the stop.

* * * * *